United States Patent [19]

Kosters

[11] 4,428,829

[45] Jan. 31, 1984

[54] PROCESS FOR SIMULTANEOUS SEPARATION OF AROMATICS FROM HEAVY AND LIGHT HYDROCARBON STREAMS

[75] Inventor: Walter C. G. Kosters, The Hague, Netherlands

[73] Assignee: Shell Oil Company, Houston, Tex.

[21] Appl. No.: 301,493

[22] Filed: Sep. 14, 1981

[30] Foreign Application Priority Data

Oct. 16, 1980 [GB] United Kingdom ..... 8033462

[51] Int. Cl.[3] ..... C10G 21/02; C10G 21/22

[52] U.S. Cl. ..... 208/314; 208/317; 208/325

[58] Field of Search ..... 208/314, 317, 322, 325

[56] References Cited

U.S. PATENT DOCUMENTS

| | | | |
|---|---|---|---|
| 2,201,549 | 5/1940 | Van Dijck | 196/13 |
| 2,717,229 | 9/1955 | Findlay | 196/14.15 |
| 3,539,503 | 11/1970 | Benham et al. | 208/317 |
| 3,544,453 | 12/1970 | Thompson | 208/321 |
| 4,081,355 | 3/1978 | Preusser et al. | 208/313 |

*Primary Examiner*—G. L. Kaplan
*Assistant Examiner*—William Leader
*Attorney, Agent, or Firm*—John M. Duncan

[57] ABSTRACT

A process for the simultaneous separation of aromatics and non-aromatics from a heavy hydrocarbon stream and a light hydrocarbon stream in which process:

(a) aromatics are extracted in a first extractor from the heavy hydrocarbon stream with the aid of a selective solvent which has a higher boiling point than that of said light hydrocarbon stream, (b) selective solvent is removed from the raffinate obtained from said first extractor, to yield heavy non-aromatics (c) aromatics are extracted from the light hydrocarbon stream in a second extractor with the aid of the extract phase obtained from the first extractor, (d) selective solvent is removed from the raffinate obtained from said second extractor to yield heavy aromatics and light non-aromatics (e) the extract phase from the second extractor is subjected to extractive distillation, (f) the bottom fraction of the extractive distillation is separated by distillation into light aromatics and selective solvent, and (g) the selective solvent obtained in step (f) is at least partially recycled to the first extractor.

8 Claims, 1 Drawing Figure

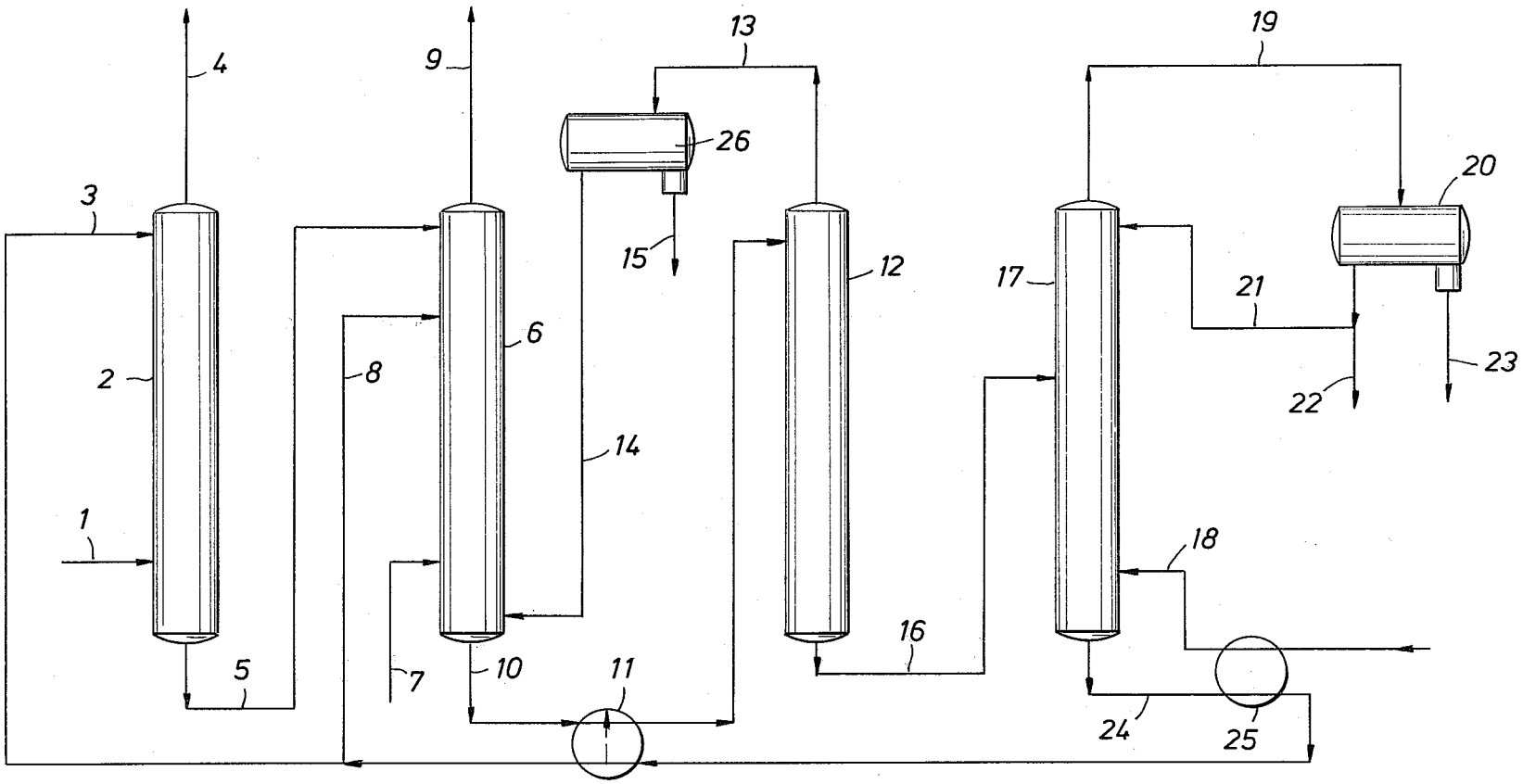
1
2
3
4
5
6
7
8
9
10
11
12
13
14
15
16
17
18
19
20
21
22
23
24
25
26

PROCESS FOR SIMULTANEOUS SEPARATION OF AROMATICS FROM HEAVY AND LIGHT HYDROCARBON STREAMS

BACKGROUND OF THE INVENTION

The invention relates to a process for the simultaneous separation of aromatics and non-aromatics from a heavy hydrocarbon stream and a light hydrocarbon stream.

It has long been known to separate aromatics and non-aromatics present in a hydrocarbon stream by extraction of the aromatics with the aid of a selective solvent, followed by distillative separation of the extract phase obtained in aromatics and solvent. Such a process is very convenient for hydrocarbon streams which have a boiling range below that of the selective solvent, because the difference in boiling points between the aromatics extracted and the selective solvent enables good separation by distillation.

The separation of hydrocarbon streams having a boiling range which is close to or comprising the boiling point of the selective solvent is more difficult, because distillative separation of aromatics extracted from such a hydrocarbon stream and selective solvent is impossible, and more complicated methods for separation are needed.

It is also known to separate aromatics simultaneously from heavy and light hydrocarbon streams, e.g., Hydrocarbon Processing, June, 1973, pages 91–94, where the extract phase which contains the aromatics extracted from the light hydrocarbon stream is used as solvent for theheavy hydrocarbon streams.

The invention provides a method in which heavy hydrocarbon streams and light hydrocarbon streams can be separated simultaneously into aromatics and non-aromatics without the need of more complicated separation methods than extraction and distillation.

SUMMARY OF THE INVENTION

According to the invention there is provided a process for the simultaneous separation of aromatics and non-aromatics from a heavy hydrocarbon stream and a light hydrocarbon stream which process is characterised in that:

(a) aromatics are extracted in a first extractor from the heavy hydrocarbon stream with the aid of a selective solvent which has a higher boiling point than that of said light hydrocarbon stream, (b) selective solvent is removed from the raffinate obtained from said first extractor, to yield heavy non-aromatics (c) aromatics are extracted from the light hydrocarbon stream in a second extractor with the aid of the extract phase obtained from the first extractor, (d) selective solvent is removed from the raffinate obtained from said second extractor to yield heavy aromatics and light non-aromatics, (e) the extract phase from the second extractor is subjected to extractive distillation, (f) the bottom fraction of the extractive distillation is separated by distillation into light aromatics and selective solvent, and (g) the selective solvent obtained in step (f) is at least partially recycled to the first extractor.

DESCRIPTION OF PREFERRED EMBODIMENTS

A light hydrocarbon stream in the context of this specification and claims is a hydrocarbon stream which has a boiling range which is lower than the boiling point (or if appropriate boiling range) of the selective solvent used.

A heavy hydrocarbon stream in the context of this specification and claims is a hydrocarbon stream which has a boiling range which is higher than that of the light hydrocarbon stream. Although there may be some overlap of the boiling range of the light and the heavy hydrocarbon streams, it is preferred that no such overlap exists. The boiling range of the heavy hydrocarbon stream may be lower or higher than or comprises the boiling point (or if appropriate boiling range) of the selective solvent used.

Light hydrocarbon streams which boil in the range from 50°–170° C., such as gasoline fractions, which may be straight run or have been obtained from a conversion process, in particular from catalytic reforming or from a pyrolysis process, are preferred.

Very suitable heavy hydrocarbon streams are boiling in the range from 150°–350° C., such as kerosines, gas oils, which may have been obtained as straight run fractions or from a catalytic or non-catalytic process e.g., thermal cracking, catalytic cracking and/or hydrocracking.

In the process according to the invention use may in principle be made of a variety of selective solvents, for example, furfural, phenol, sulphoxides fatty acid alkyl amides. Preferred is the use of solvents which at least in part are of the sulfolane, the glycol, the morpholine and/or the pyrrolidone/piperidone type; i.e., sulfolane (cyclic tetramethylene sulphone), the unsaturated analogues thereof and the derivatives of both, as described, for example, in U.K. Patent Specification No. 625,505; lower polyalkylene glycols (such as diethylene, triethylene, tetraethylene, and dipropylene glycol); morpholine as well as substituted morpholines such as formylmorpholine; pyrrolidone and piperidone, as well as their derivatives (such as N-alkyl-, in particular N-methylpyrrolidone and -piperidone). If desired, the selective solvent may contain a quantity of a substance, such as water, which has a favourable effect on the selectivity and/or the solvent power thereof. The use of a selective solvent which totally or substantially consists of sulfolane is in particular preferred.

The extractions in the first and second extractor are preferably carried out in multistage; use may be made of any suitable equipment. The extractions may e.g., be carried out with the aid of a number of mixing and settling steps. It is preferred to carry out the extractions by means of an extraction column, in particular a rotating disc contactor such as described e.g. in U.K. patent specification No. 659,241.

The raffinates from the first and second extractor contain a small amount of the selective solvent which is to be removed. It is preferred to wash these raffinates with water in order to remove the selective solvent therefrom.

The extract phase from the first extractor which contains aromatics extracted from the heavy hydrocarbon stream (also indicated as heavy aromatics) is used as the extracting solvent for the light hydro-carbon stream in the second extractor. As a result of this extraction a raffinate is obtained which comprises all or the greater part of the heavy aromatics and the non-aromatics extracted from the light hydrocarbon stream (also indicated as light non-aromatics) together with a small amount of selective solvent; the extract phase containing all or the greater part of the aromatics extracted from the light hydrocarbon stream (also indicated as light aromatics). The raffinate can (after having been washed with water) if desired be easily separated in light non-aromatics and heavy aromatics by distillation because of the difference in boiling ranges between these fractions.

The extract phase from the second extractor which contains light aromatics and part of the light non-aromatics is subjected to extractive distillation in order to remove the light non-aromatics therefrom. In an extractive distillation hydrocarbons at least partially in the vapour phase are contacted with liquid selective solvent, as a result of which aromatics are separated from non-aromatics, the latter being removed in the vapour form.

The overhead fraction of the extractive distillation which contains light non-aromatics and a small amount of light aromatics is very suitably condensed, the water layer (if any) is removed, and the hydrocarbon layer is recirculated to the second extractor.

The greater part of the light aromatics remains in the bottom fraction of the extractive distillation. According to the invention these light aromatics are separated from the selective solvent by distillation of the bottom fraction of the extractive distillation.

This distillation is very conveniently carried out in a separate column, very suitably under reduced pressure. Preferably steam is introduced to improve the separation. The overhead product which contains steam and light aromatics is cooled, the water layer is separated and the light aromatics (which may be partially recycled to the distillation column) are removed.

As a matter of course the amount of fresh water to be introduced into the system can be kept limited by reintroduction into the system of at least part of the aqueous liquids becoming available from the water-washes of the raffinates of the extractors, from the top product of the distillation in which the selective solvent is separated from the light aromatics. It is in particular attractive to use at least part of the water phase obtained as top product of the distillation in which the selective solvent is separated from the light aromatics as washing medium for the raffinates.

The selective solvent obtained after removal of the light aromatics is at least partially recycled to the first extractor. If desired part thereof may be recycled to the second extractor, and may be introduced therein together with the extract phase from the first extractor and/or at a point nearer to the entrance of the light hydrocarbon stream into the second extractor. If desired, part of the selective solvent may also be introduced into the extractive distillation column.

The invention will be illustrated with reference to the accompanying drawing, which is a schematic representation of apparatus for practicing one embodiment of the invention.

A heavy hydrocarbon stream is introduced via line 1 into the first extractor 2, into which first extractor selective solvent is introduced via line 3. Raffinate is leaving extractor 2 via line 4, and is water-washed (not shown). The extract phase is removed via line 5 and introduced into the second extractor 6. A light hydrocarbon stream is introduced into extractor 6 via line 7. In the embodiment of the invention depicted selective solvent is introduced into extractor 6 via line 8. The raffinate which leaves extractor 6 via line 9, is water-washed (not shown) and is distilled (not shown) to yield heavy aromatics and light non-aromatics. The extract phase is leaving extractor 6 via line 10 and is led via heat-exchanger 11 to extractive distillation column 12. The top product thereof is forwarded to a separation vessel 26 via line 13. From this vessel the water layer is removed via 15, and the hydrocarbon layer is recycled to extractor 6 via line 14. The bottom product from the extractive distillation column 12 is forwarded via line 16 to distillation column 17. Steam is introduced into this column via line 18. The top product is led to separation vessel 20 via line 19. From this vessel the water layer is removed via line 23 and the hydrocarbon layer (light aromatics) is partly recycled to the distillation column 17 via line 21 and partly removed via line 22. The regenerated selective solvent obtained as bottom product from distillation column 17 is removed therefrom via line 24, and led via heat exchangers 25 and 11 partly to extractor 2 and partly to extractor 6.

EXAMPLE 61 t/d of a kerosine fraction with a boiling range of 190°-240° C., which contains 20% w aromatics, is fed to extractor 2 via line 1. The extractor is a rotating disc contactor of the type described in British patent specification No. 659,241. The extraction is carried out at a temperature of 125° C. with sulfolane forwarded via line 3 in an amount of 555 t/d. The raffinate leaving the extractor via line 4 is washed with water yielding 37 t/d of heavy non-aromatics (the aromatics content is below 1% w). To extractor 6 (which is also a rotating disc contactor) there are fed via line 7 122 t/d of a light straight run hydrocarbon fraction with a boiling range of 55°-85° C. which contains 5% w benzene. The extract phase from extractor 2 (579 t/d) is introduced into extractor 6 via line 5. The temperature in extractor 6 is 90° C. Via line 8 430 t/d sulfolane is also introduced into extractor 6. The raffinate phase leaving the extractor via line 9 is washed with water yielding 134 t/d raffinate. The extract phase of extractor 6 (1025 t/d) is fed (after being heat-exchanged in heatexchanger 11) to extractive distillation column 12 via line 10. The extractive distillation in column 12 is carried out at a pressure of 0.2 bar and a bottom temperature of 175° C. The overhead product is forwarded via line 13 to separator 26 and separated in a water phase and a hydrocarbon phase; the hydrocarbon phase is recycled to extractor 6 via line 14. The bottom product of column 12 is fed via line 16 to distillation column 17 which is heated with steam from line 18. The top product is led via line 19 to separator 20, the hydrocarbon phase (light aromatics) obtained therein partly recycled to the distillation column via line 21, and partly removed via line 22 in the amount of 12 t/d. The raffinate emerging via line 9 from extractor 6 (which contains less than 100 ppm benzene) is water washed and distilled yielding 24 t/d heavy aromatics and 110 t/d food-grade hexane.

What is claimed is:

1. A process for the simultaneous separation of aromatics and non-aromatics from a heavy hydrocarbon stream and a light hydrocarbon stream which comprises:

(a) extracting aromatics in a first extractor from the heavy hydrocarbon stream with the aid of a selective solvent which has a higher boiling point than that of said light hydrocarbon stream, (b) removing selective solvent from the raffinate obtained from said first extractor, to yield heavy non-aromatics, (c) extracting aromatics from the light hydrocarbon stream in a second extractor with the aid of the extract phase obtained from the first extractor, (d) removing selective solvent from the raffinate obtained from said second extractor to yield heavy aromatics and light non-aromatics, (e) subjecting the extract phase from the second extractor to extractive distillation, (f) separating the bottom fraction of the extractive distillation by distillation into light aromatics and selective solvent, and (g) recycling the selective solvent obtained in step (f) at least partially to the first extractor.

2. A process according to claim 1, wherein the selective solvent which has a higher boiling point than that of said light hydrocarbon stream consists totally or substantially of sulfolane.

3. A process according to claim 1 or 2, wherein the light hydrocarbon stream boils in the range from 50°–170° C.

4. A process according to claim 1 or 2 wherein the heavy hydrocarbon stream boils in the range from 150°–350° C.

5. A process according to claim 1 wherein the selective solvent is removed from the raffinates from the first and/or second extractor by washing with water.

6. A process according to claim 1 wherein the heavy aromatics and the light non-aromatics obtained in step (d) are separated by distillation.

7. A process according to claim 1 wherein the overhead product of the extractive distillation is at least partially recycled to the second extractor.

8. A process according to claim 1 wherein part of the selective solvent obtained in step (f) is recycled to the second extractor.

* * * * *